US006530250B1

(12) United States Patent
Linares et al.

(10) Patent No.: US 6,530,250 B1
(45) Date of Patent: Mar. 11, 2003

(54) LOCKING FOLDING T-HANDLE DOOR LATCH

(75) Inventors: Rodolfo Linares, Whittier, CA (US); George N. Alvarado, Whitter, CA (US)

(73) Assignee: S.P.E.P. Acquisition Corporation, Ranch Dominguez, CA (US)

( * ) Notice: Subject to any disclaimer, the term of this patent is extended or adjusted under 35 U.S.C. 154(b) by 0 days.

(21) Appl. No.: 10/011,801

(22) Filed: Dec. 4, 2001

(51) Int. Cl.[7] ..... E05B 13/10

(52) U.S. Cl. ..... 70/208; 292/DIG. 30; 292/DIG. 31; 292/207

(58) Field of Search ..... 70/209–211, 208, 70/81; 292/336.3, DIG. 30, DIG. 31, 207

(56) References Cited

U.S. PATENT DOCUMENTS 4,370,874 A * 2/1983 Munn ..... 70/204
4,438,964 A * 3/1984 Peters ..... 292/216
4,480,451 A * 11/1984 Fujiya ..... 70/92
4,706,478 A * 11/1987 Swan et al. ..... 70/28
4,989,907 A * 2/1991 Edmonds et al. ..... 292/223
5,526,660 A * 6/1996 Bennett et al. ..... 70/208
5,820,174 A * 10/1998 Parikh et al. ..... 292/126
5,913,908 A * 6/1999 Czipri ..... 70/208
5,941,104 A * 8/1999 Sadler ..... 70/208
5,984,383 A * 11/1999 Parikh et al. ..... 292/121
6,418,761 B1 * 7/2002 Wytcherley et al. ..... 70/208
6,454,321 B1 * 9/2002 Parikh ..... 292/216

* cited by examiner

*Primary Examiner*—Anthony Knight
*Assistant Examiner*—John B. Walsh
(74) *Attorney, Agent, or Firm*—Christie, Parker & Hale, LLP

(57) ABSTRACT

The locking folding T-handle door has a handle, a locking cam with a cutout portion, a latch cam, and a handle shaft rotatably fixing the handle, the locking cam and the latch cam together. A lock, a pan with an aperture formed therethrough for the handle shaft and an aperture for the lock are provided. A slide bar activation cam is fitted to the lock and is adapted to be turned by the lock. A slide bar located between the locking cam and the slide bar activation cam is provided. The slide bar is slidably retained by a slide retainer fixed to an underside of the pan. The slide bar is adapted to be moved into the cutout portion of the locking cam by locking the lock, which thereby prevents the handle from being turned to move the latch cam.

21 Claims, 8 Drawing Sheets

LOCKING FOLDING T-HANDLE DOOR LATCH

BACKGROUND OF THE INVENTION

The invention relates generally to folding handle operated door locks, and more specifically to folding T-handle operated door locks easily assembled from a relatively small number of components, which require minimum welding, and which positively open and close.

Locking door latches are well-known and are used in a variety of applications, including applications where flush mounting is desirable, such as door locks for equipment cabinets and for delivery vehicles. One feature common to locking folding T-handle door latches is that the door latches have a folding operating handle which can be folded down into a recess when not in use. Some drawbacks of prior art door latches include numerous moving parts and/or the requirement of utilizing a number of welds, springs and small parts which can be damaged or rendered inoperable by abuse and/or during painting, and accordingly may be subject to reliability problems.

SUMMARY OF THE INVENTION

The present invention overcomes drawbacks of prior folding handle latches by providing an improved, relatively simple and inexpensive to manufacture folding handle operated door lock which has relatively few parts, which requires few welds, has no springs or other small parts which can be jammed with painting, and which utilizes a key locking system which could easily retain rotatable components in pre-determined positions relative to housing, namely, a latched and unlatched position.

The operating T-handle is preferably nestable within a pan when the T-handle is in its locked position. A key lock is included to releasably lock the T-handle and a latch cam connected to the T-handle. The locking cam and the key lock are spaced apart by virtue of a slide bar which is movable between a locked position and an unlocked position, the locked position being when it is moved into contact with a cutout area of a locking cam connected together with the latch cam. In the unlocked position, the slide bar is moved out of the cutout area of the locking cam. No springs are required to move the slide bar between the locked and unlocked positions, as the action is positive.

DETAILED DESCRIPTION OF THE PREFERRED EMBODIMENTS OF THE INVENTION

Figure 1:
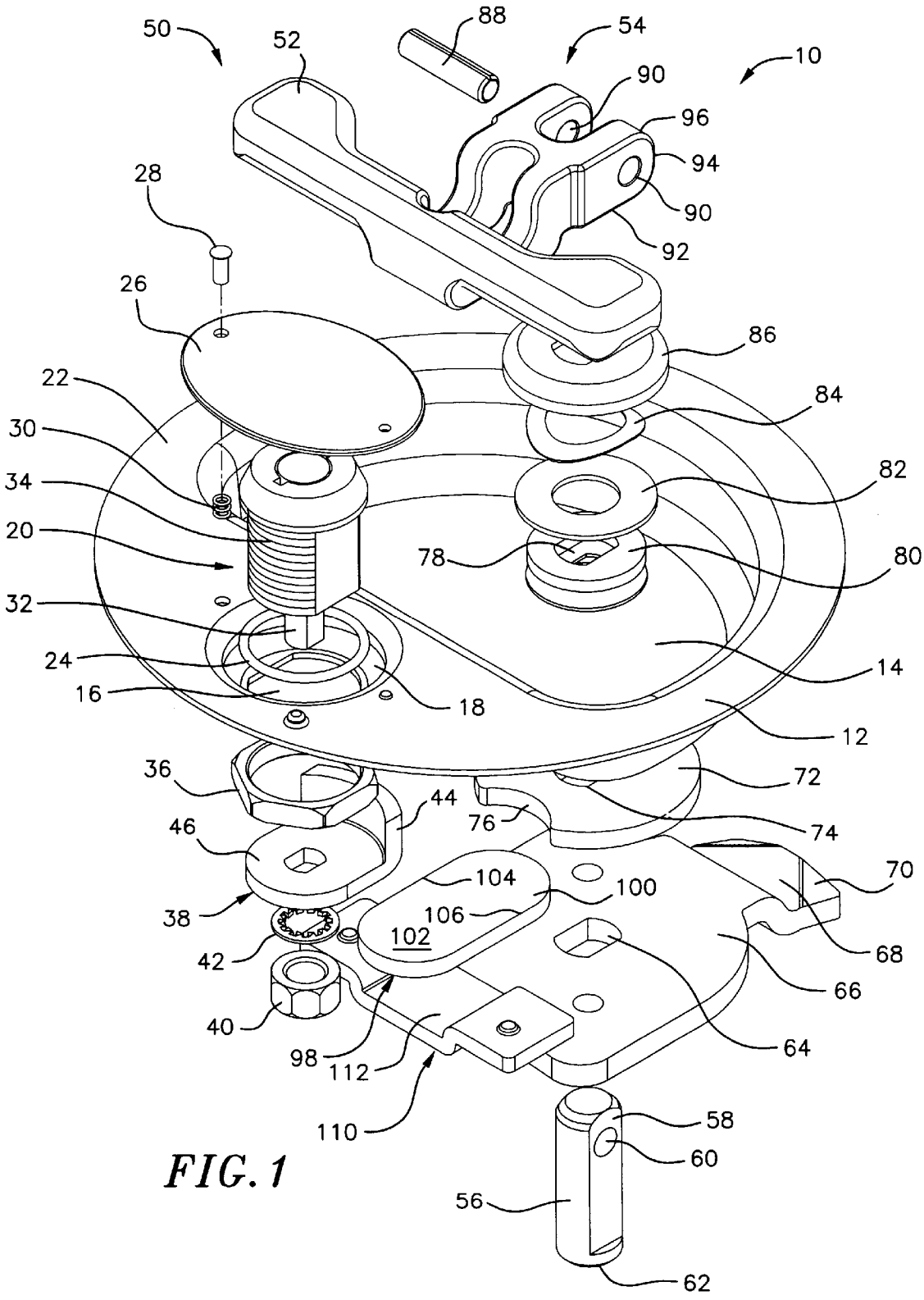
FIG. 1 is an exploded top perspective view of the locking folding T-handle door latch of the invention showing its parts.
Figure 4:
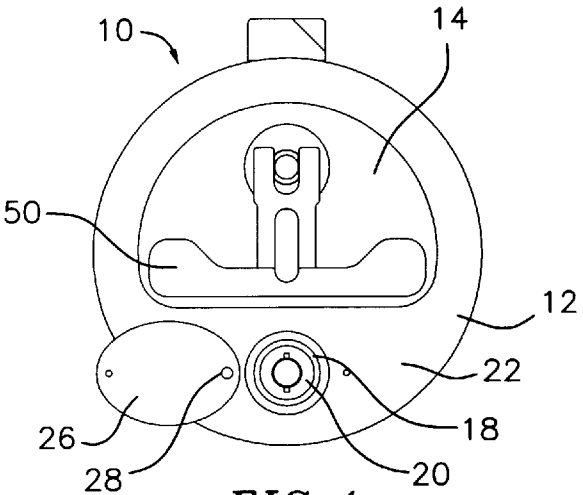
FIG. 4 is a top plan view of the locking folding T-handle door latch of FIG. 2, with the key cover in its open position.
Figure 3:
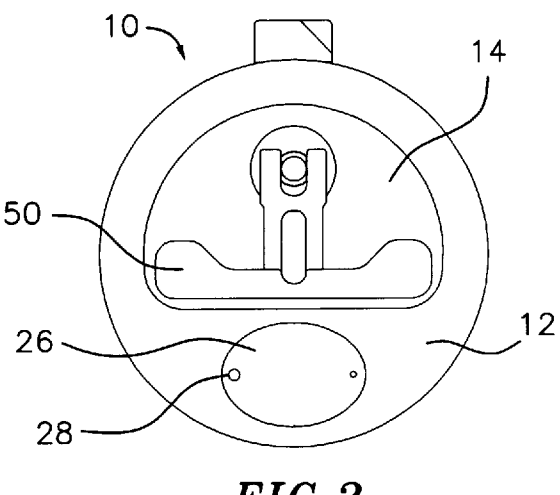
FIG. 3 is a top plan view of the locking folding T-handle door latch of FIG. 2 with its key cover in the closed position.
Figure 2:
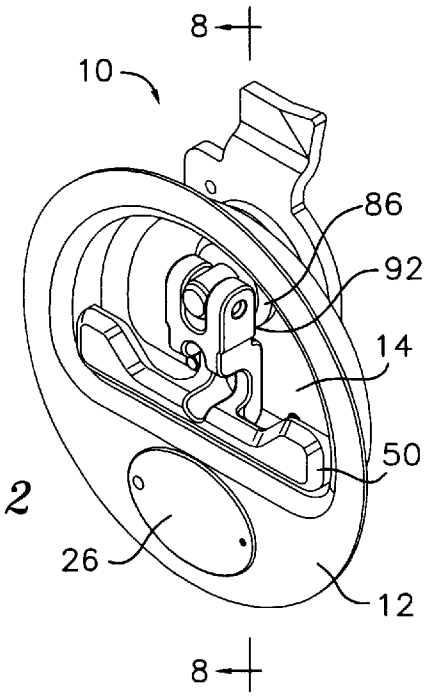
FIG. 2 is a perspective view of the locking folding T-handle door latch of FIG. 1 in its locked position.

Turning first to FIG. 1, there is shown an exploded view of the first embodiment of the locking folding T-handle door latch 10 of the invention. The locking folding T-handle door latch 10 has pan 12 with a recess 14 formed therein. A lock retention opening 16 is formed through pan and preferably is formed in a well 18 so that the top of a lock 20 does not extend above the top surface 22 of pan. A seal 24 is preferably utilized to provide a seal between lock 20 and lock retention opening 16 to provide for weather protection for lock. Preferably, a cover assembly 26 is pivotally affixed to pan (e.g. with a pin 28) and can also include a biasing means 30 (such as a spring) so that a cover assembly can be moved between a closed position covering well 18 and lock 20, as shown in FIGS. 2 and 3, to an open position, as shown in FIG. 4. Lock has a shaft 32, and a threaded lock body 34 which is retained within the well with a nut 36 or other means. A slide bar activation cam 38 is attached to shaft 32, for example, with a nut 40 with a lock washer 42. Slide bar activation cam 38 has a contact portion 44 which is preferably curved and can have a greater height than a height of an intermediary portion 46 of slide bar activation cam. A handle 50, for example a T-handle, has a grasping portion 52 and a pivot end 54. A handle shaft 56 has a distal end 58 with an attachment means, such as a bore 60 formed therethrough, and a proximal end 62. Handle shaft 56 has a cross-section which is adapted to be non-rotatably inserted through an aperture 64 in a latch cam 66. Latch cam 66 has a latch end 68 and can have a turned down corner 70, the function of which is described further below. A locking cam 72 has a locking cam aperture 74 formed therethrough sized to slidably but non-rotatably receive the handle shaft 56. Locking cam 72 further has a cutout 76 formed on one side thereof, which is preferably generally semi-circular. Handle shaft is engaged through aperture 64 in latch cam 66, passes through aperture 74 in locking cam 72, and passes through an aperture 78 in pan portion 12. A seal 80, a seal washer 81, a washer 82, a spring means such as a disc spring 84 and a collar 86 have apertures through which handle shaft extends. At pivot end 54 of handle 50, handle is pivotally fixed to distal end 58 of handle shaft 56, for example, with a pin 88 which pivotally engages pivot end of handle through apertures 90 with bore 60 in handle shaft. Disc spring 84 exerts a force on collar 86 which is transferred to pivot end 54 of handle, thereby exerting a force on pivot end 54 so it can maintain the position of handle in either a lowered position or raised position. Pivot end 54 preferably has a flat side 92 and preferably a flat end 94 with rounded corners 96 therebetween. A slide bar 98, for example, having an obround shape with a first rounded end 100, faces locking cam 72, and both are on the same general plane. Slide bar 98 has a second rounded end 102 facing contact portion 44 of slide bar activation cam 38. Slide bar preferably has parallel sides 104 and 106. First rounded end 100 of slide bar 98 is sized and shaped to be received within semi-circular cutout 76 of locking cam 72.

Figure 7:
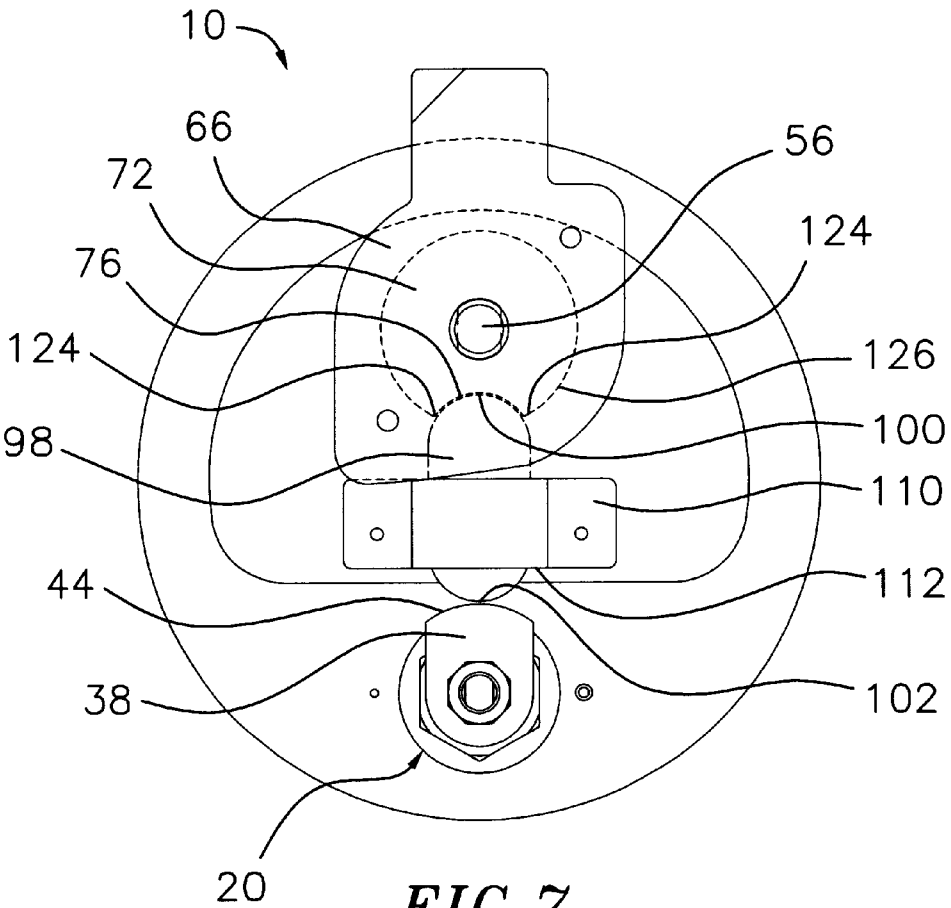
FIG. 7 is a partially exposed bottom plan view of the locking folding T-handle door latch of FIG. 2 in its locked position.

Referring to FIG. 7, cutout 76 preferably is rounded at the corners 124 where the semi-circular cutout 76 joins with the perimeter 126 of locking cam 72. A slide retainer 110 with a slide channel 112 is adapted to slidably receive slide bar 98 and is affixed to a bottom surface of pan portion 12 (e.g. with spot welds or other attachment means).

Figure 11:
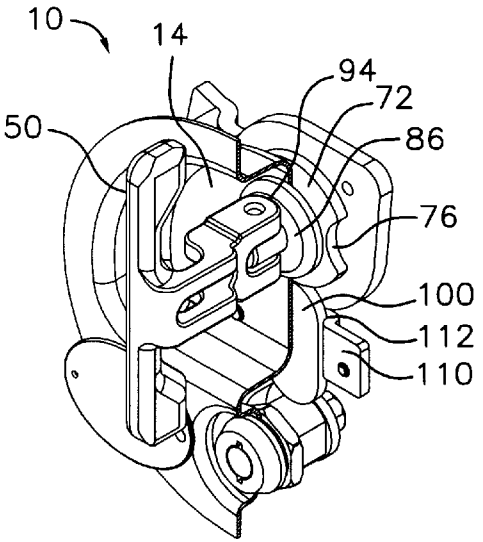
FIG. 11 is a partially exposed view of the lock of FIG. 2 along view lines 8—8, showing the locking folding T-handle door latch in the open position.
Figure 9:
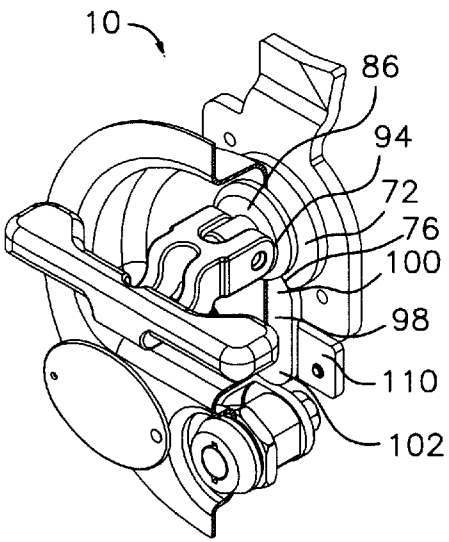
FIG. 9 is a partially exposed view of the locking folding T-handle door latch of FIG. 2, with the pan exposed along view lines 8—8, without cross-sectioning the other parts and with its T-handle in the raised position.
Figure 12:
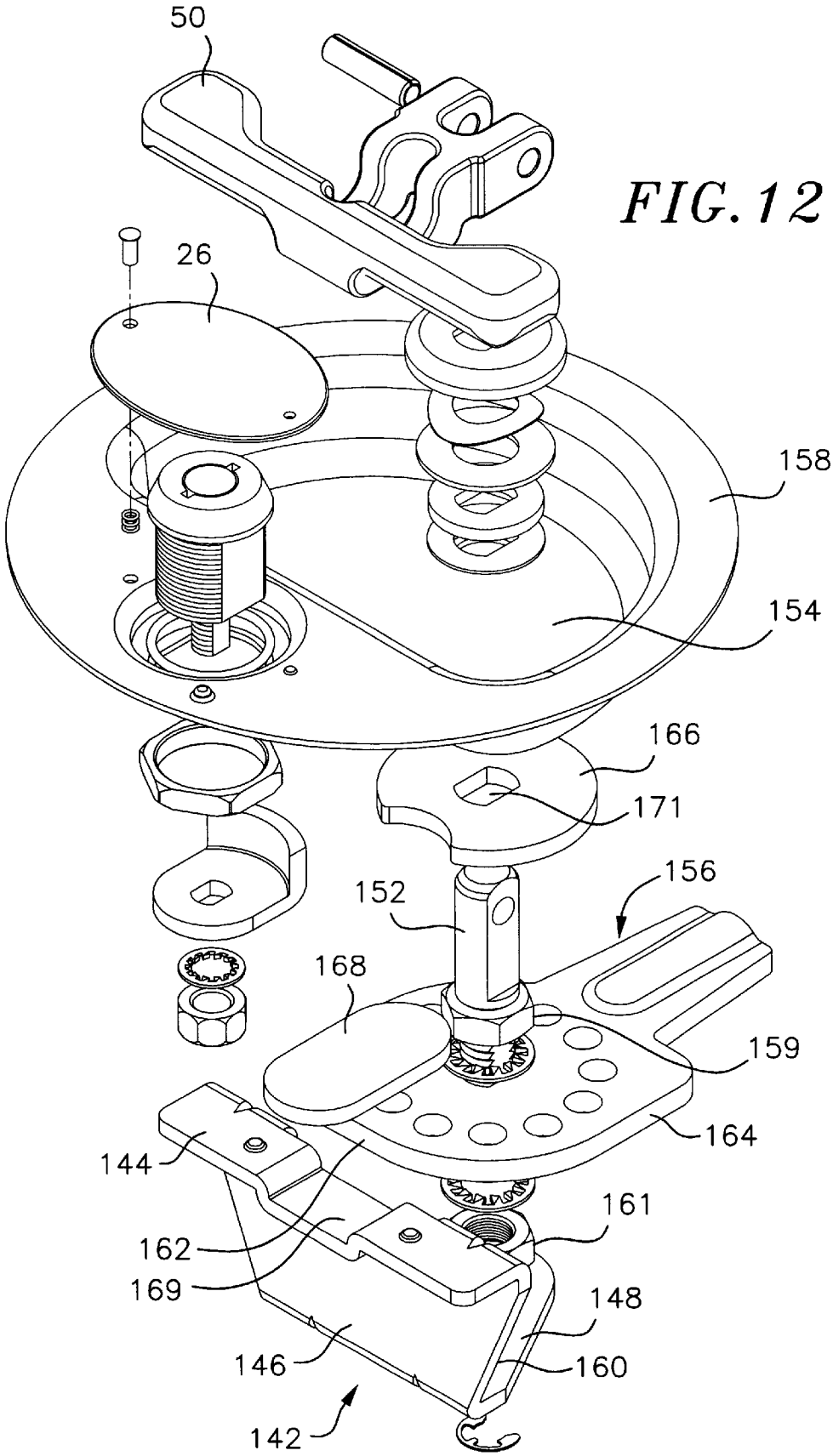
FIG. 12 is an exploded view of a second embodiment of the locking folding T-handle door latch of the invention.
Figure 15:
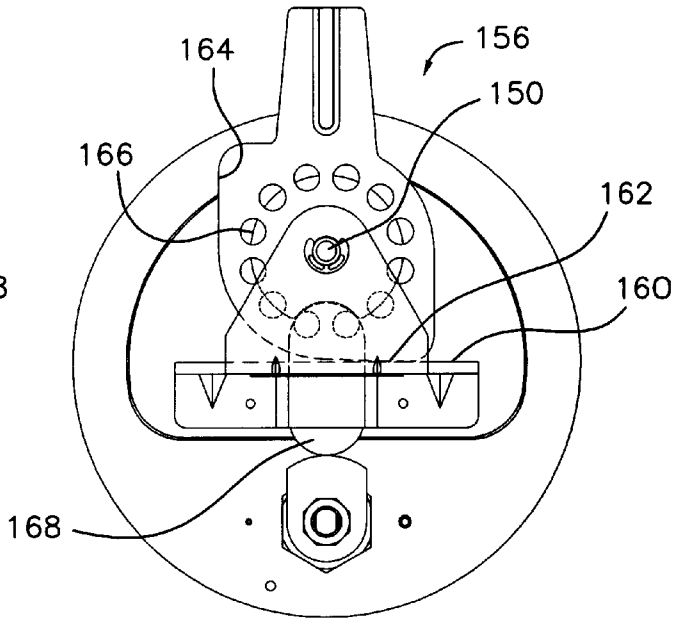
FIG. 15 is a bottom plan view of the folding T-handle door latch of FIG. 13, in the locked position.
Figure 14:
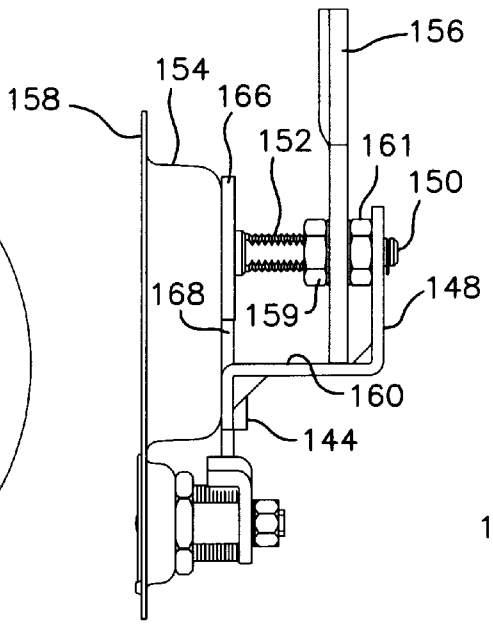
FIG. 14 is a right side view of the folding T-handle door latch of FIG. 12.
Figure 13:
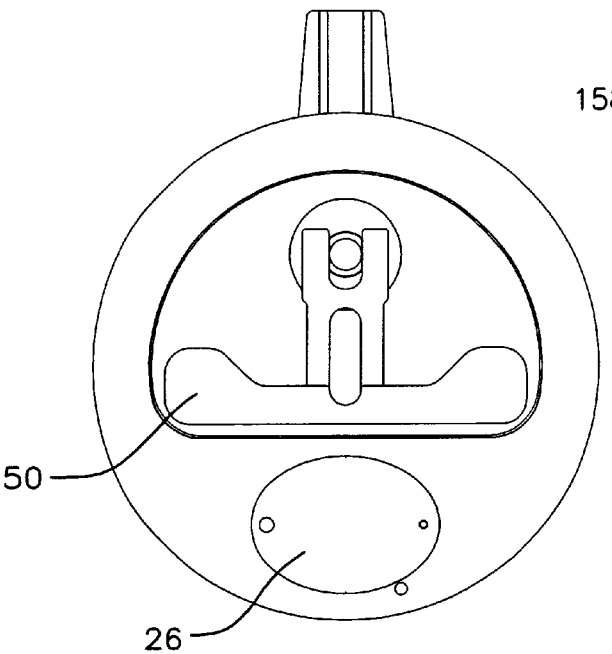
FIG. 13 is a top plan view of the assembled locking folding T-handle door latch of FIG. 12.

Turning next to FIG. 2, there is shown an upper right side perspective view showing the assembled folding T-handle door latch 10 in its locked position and with its handle 50 flipped down into recess 14 of pan portion 12, and with cover assembly 26 in its closed position. Collar 86 is shown exerting force on flat side 92 of pivot end 54. Flat side 92 of pivot end 54 of handle 50 rests on springloaded collar 86 when handle 50 is folded down into well 14. The spring-loading retains handle in a closed folded down position and prevents handle from rattling within recess. When handle 50 is flipped up to its open position as shown in FIGS. 9 and 11, flat end 94 of handle will contact with spring loaded collar 86 and will be retained in that position until it is flipped down by the user.

FIG. 3 is a top plan view of the folding T-handle door lock 10 of FIG. 2 with its handle 50 folded down into recess 14 of pan portion 12 and with cover assembly 26 covering lock (not shown).

FIG. 4 is a top plan view of the folding T-handle door latch of FIG. 2, but with cover assembly 26 rotated about its pin 28 to reveal lock 20 fixed within well 18 of top surface 22 of pan 12.

Figure 5:
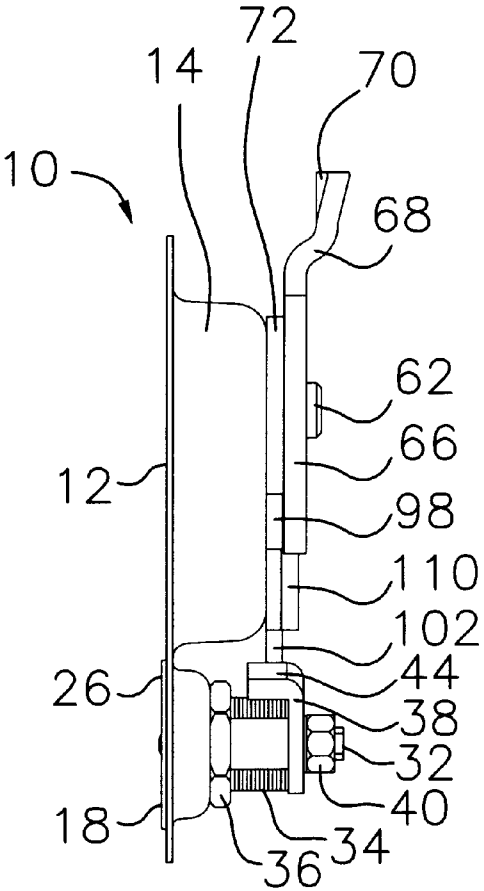
FIG. 5 is a right side view of the locking folding T-handle door latch of FIG. 2.

FIG. 5 is a right side view showing folding door latch 10 in its locked position and shows the interrelationship between slide bar activation cam 38, slide bar 98, slide retainer 110, locking cam 72 and latch cam 66, which are connected to proximal end 62 of the handle shaft. Lock body 34 is fixed within well 18 with nut 36, and slide bar activation cam 38 is retained to lock shaft 32 with nut 40. Turned down corner 70 of latch end 68 functions to ease latch cam into a locking position with a door jam or other structure (not shown).

Figure 6:
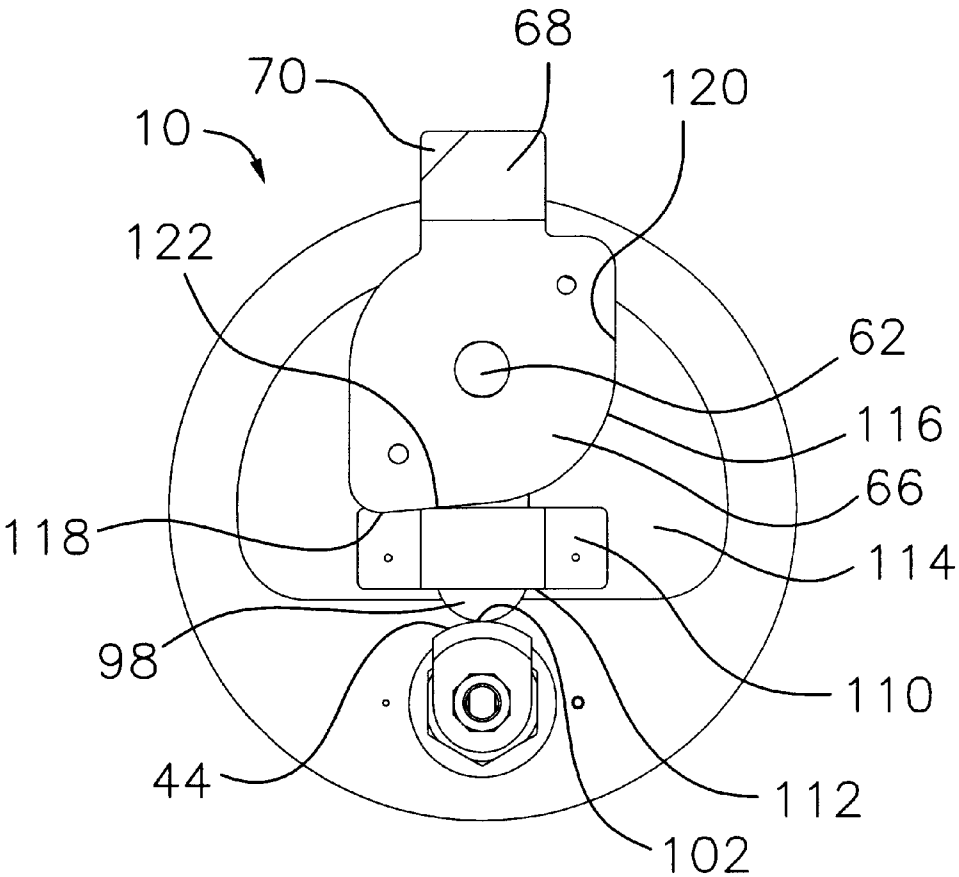
FIG. 6 is a bottom plan view of the locking folding T-handle door latch of FIG. 2.

Turning to FIG. 6, there is shown a bottom plan view of the folding T-handle door lock 10 of FIG. 2. As shown, slide retainer 110 is affixed to a bottom surface 114 of recess by spot welding or other means and slidably retains slide bar 98 in its slide channel 112. As shown, contact portion 44 of slide bar activation cam is in contact with second rounded end 102 of slide bar 98. Latch cam 66 is shown fitted to handle shaft, with proximal end 62 being shown. Latch cam 66 is positioned below bottom surface 114 of pan. Latch cam 66 has a curved side 116 with a lock position contact surface 118 on one end and an open position contact surface 120 on another end. Slide retainer 110 has a front facing contact surface 122 upon which lock position contact surface 118 of latch cam 66 makes contact when latch cam is in locked position as shown in FIG. 6, and which open position contact surface 120 makes when latch cam 66 is in the open position (shown in FIG. 10).

FIG. 7 is a bottom plan view showing the folding T-handle door lock of FIG. 6, but with locking cam 72 and slide bar 98 revealed under latch cam 66. As is shown, in the lock position, first rounded end 100 of slide bar 98 is slid into semi-circular cutout 76 of locking cam 72 and is held in that position by contact portion 44 of slide bar activation cam 38, which in turn is locked into position by lock 20. Any attempt to turn latch cam 66 by turning handle shaft 56 is prevented and the folding T-handle door remains in a locked position.

Figure 8:
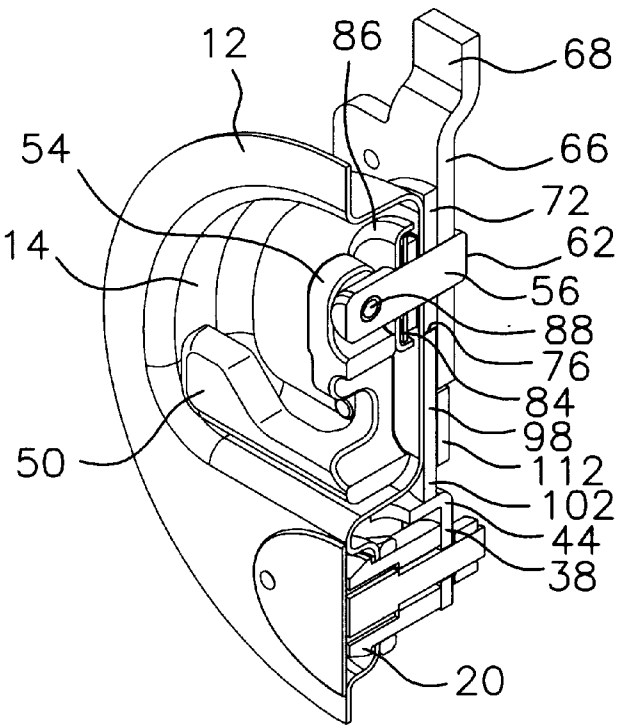
FIG. 8 is a cross-sectional view of the lock of FIG. 2 along view lines 8—8 of FIG. 2.

Turning next to FIG. 8, there is shown a cross-sectional view along view lines 8—8 of FIG. 7, further showing interconnection of the various connected and moving parts. The interconnection between pivot end 54, pin 88, handle shaft 56, aperture 64 are shown. In the locked position shown, contact portion 44 of slide bar activation cam 38 rides on second rounded end 102 of slide bar 98, thereby forcing it into cutout 76 of locking cam 72.

FIG. 9 is a similar view as FIG. 8 except does not cut through structures other than pan and shows handle 50 in its folded up position. Again, as can be seen in the locked position, sliding bar 98 is in position with first rounded end 100 positioned in semicircular cutout 76 of locking cam 72. However, lock 20 is turned such that contact surface 44 of slide bar activation cam 38 is rotated out of contact with second rounded end 102 of slide bar 98, thereby allowing handle 50 to be rotated counterclockwise as shown in FIG. 11. Preferably, as can be seen in FIG. 7, corners 124 of the interface between semicircular cutout 76 and perimeter 126 of locking cam 72 are rounded so that by turning handle 50, locking cam 72 will ease first rounded end 100 of slide bar 98 out of semi-circular cutout 76 as handle is turned counterclockwise to the position shown in FIG. 11.

Figure 10:
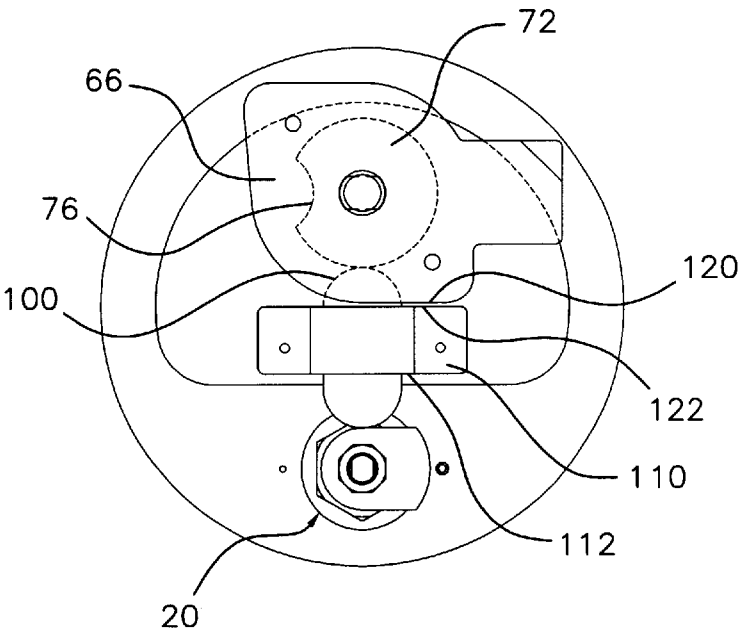
FIG. 10 is a bottom plan view of the locking folding T-handle door latch of FIG. 2 with the lock in the open position.

Turning to FIG. 10, there is shown a partially exposed bottom plan view in the open position, wherein slide bar 98 is slid out of semicircular cutout 76 by rotating handle, so that open position contact surface 120 makes contact with contact surface 122 of slide retainer 110. This prevents handle 50 from being overrotated, and prevents lock 20 from being locked. When handle is turned to place locking cam 72 with its cutout 76 in position to receive first end 100 of slide bar 98, turning lock to move slide bar activation cam 38 from the position of FIG. 10 to the position of FIG. 7 will cause slide bar to slide back into cutout 76, resulting in a positive activation.

FIG. 11 is a partially exposed top plan view showing the folding panel door latch 10 in its open position immediately after its handle 50 is rotated counterclockwise. As can be seen, first rounded end 100 of slide bar 98 is eased out of semicircular cutout 76 in locking cam 72 and slides through slide channel 112 of slide retainer 110. Handle preferably is sized to fit such that in the open position, it cannot be lowered to nest within recess 14. This serves a useful function to signal that the folding T-handle door latch is in its unlocked position. Moreover, lock 20 can be of a type that only permits its key (not shown) to be removed when the lock is locked.

Turning next to FIGS. 12–15, there is shown an alternate embodiment of the folding T-handle door latch 140. This second embodiment is similar to the first embodiment except it includes a bracket 142. Bracket 142 has a pan attachment end 144, a standoff portion 146 and a retention end 148 with an aperture formed therein (not shown), which rotatably receives an end of handle shaft 152 which is preferably threaded rearwardly of bottom 154 of pan. The position of a latch cam 156 on a handle shaft 152 can be adjusted by moving nuts 159 and 161. This feature will permit the adjustment of the vertical height of latch cam 156 relative to a top of pan 158 (e.g. to adjust for different latch depth requirements). Standoff portion 146 provides a contact surface 160 for sides 162 and 164 of latch cam 156. Retention end 148 of bracket 142 prevents handle shaft 152 from being forced downwardly (e.g. by hammering) to disengage a locking cam 166 from a locking bar 168, e.g. by pounding on handle shaft 152 or attempting to pull on handle shaft. Locking bar 168 is slideable within a channel 169 of bracket 142. The turning and locking operation of latch, locking cam, slide bars are the same as described with respect to the first embodiment of the device. Handle shaft 152 preferably has a non-round cross-section which passes through a matching non-round cross-section of an aperture 171 of latch cam which ensures that turning the handle shaft with handle 50 rotates latch cam 156. While slide bar 98 is shown as having semi-circular rounded ends, other rounded contours could be used as well.

Figure 17:
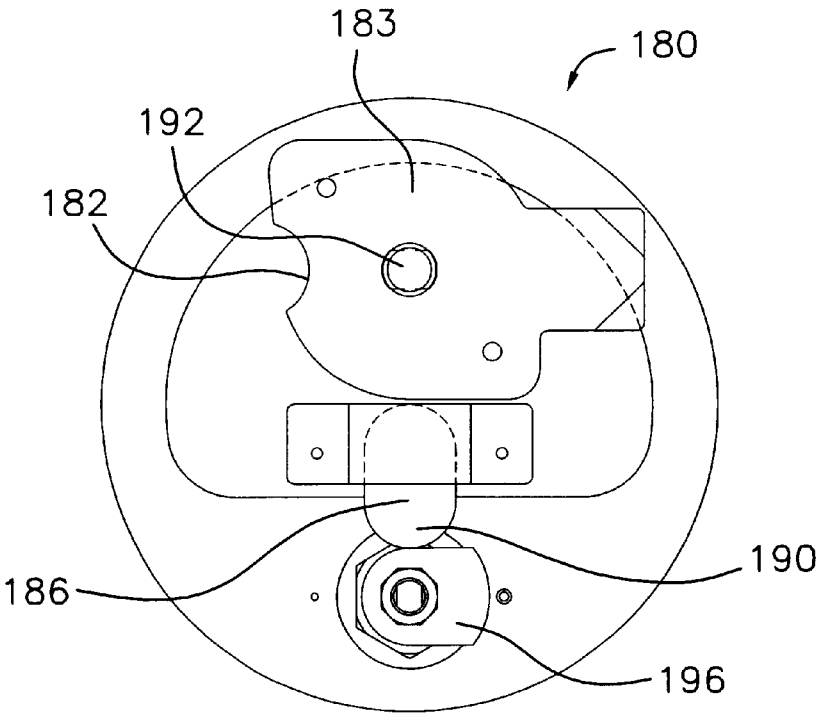
FIG. 17 is a bottom plan view of a third embodiment of the folding T-handle door latch of FIG. 16, but in the open position.
Figure 16:
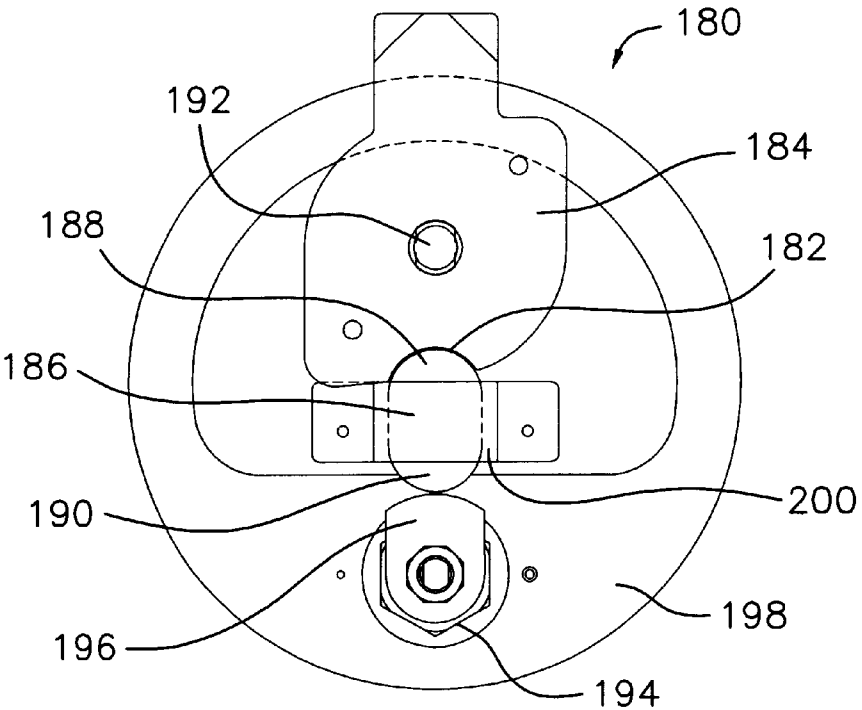
FIG. 16 is a bottom plan view of a third embodiment of the folding T-handle door latch, where the function of the lock cam and latch cam are combined, in a locked position.

FIGS. 16 and 17 are bottom plan views of a third embodiment of a folding T-handle door latch 180, which is similar to that shown in FIGS. 1–11, except that a cutout 182 is formed in a latch cam 184 and no separate locking cam is provided. In other respects, the third embodiment is the same as the first embodiment. A slide bar 186 has a first end 188 which is sized to be received in cutout 182. Slide bar 186 also has a second end 190. A handle is provided (not shown, but can be the same as in the first and second embodiments) which is fitted to a handle shaft 192. A lock 194 with a slide bar activation cam 196, and a pan 198 which carries the parts, are provided. Slide bar 186 is slidably retained by a slide retainer 200. The operation of folding T-handle door latch 180 is similar to that of the first embodiment, except that slide bar 186 moves into contact and engages within cutout 182 of latch cam 184, rather than into a lock cam.

The embodiments of the invention are similar in that the slide bars are moved by the slide bar activation cam and are moved out of a cutout of the lock cam or latch cam by turning the handle, which occurs when the lock is in the unlocked position. Constructed as such, there are no springs required. The locking and unlocking are all positively actuated, and even if paint or other debris becomes deposited or lodged on the back of the folding T-handle door latch, the latch will still function. Moreover, unlike prior art designs, in particular in the case of the first design, there is very little welding and assembly required.

Having thus described exemplary embodiments of the present invention, it should be understood by those skilled in the art that the above disclosures are exemplary only and that various other alternatives, adaptations and modifications may be made within the scope of the present invention. The presently disclosed embodiments are to be considered in all respects as illustrative and not restrictive. The scope of the invention being indicated by the appended claims, rather than the foregoing description, and all changes which come within the meaning and range of equivalency of the claims are, therefore, intended to be embraced therein.

What is claimed is:

1. A locking folding T-handle door latch, comprising:

a handle;

a locking cam with a cutout portion;

a latch cam;

a handle shaft rotatably fixing the handle, the locking cam and the latch cam together;

a lock;

a pan with an aperture formed therethrough for the handle shaft and an aperture for the lock;

a slide bar activation cam turnable by the lock;

a slide bar having a first end sized to at least partially fit into the cutout portion of the locking cam, the slide bar being located between the locking cam and the slide bar activation cam; and wherein the slide bar is moveable into the cutout portion of the locking cam by locking the lock, which thereby prevents the handle from being turned to move the latch cam, and wherein when the lock is unlocked, the handle is turned to move the first end of the slide bar out of the cutout portion of the locking cam to thereby permit turning the latch cam.

2. The locking folding T-handle door latch of claim 1, wherein the pan portion has a recess formed therein which is sized to receive the handle when the handle is folded down.

3. The locking folding T-handle door latch of claim 1, wherein the handle is pivotally attached to an upper end of the handle shaft.

4. The locking folding T-handle door latch of claim 2, wherein the handle is fitted to the handle shaft and to the latch cam such that the handle can only be folded down when the latch cam is in a lock position.

5. The locking folding T-handle door latch of claim 1, wherein the pan portion has a well formed therein which is sized to receive the lock such that a top surface of the lock is below a top surface of the pan.

6. The locking folding T-handle door latch of claim 5, further comprising a cover assembly for covering the top surface of the lock.

7. The locking folding T-handle door latch of claim 1, further comprising a slide retainer fixed to an underside of the pan for slideably retaining the slide bar.

8. The locking folding T-handle door latch of claim 1, wherein the handle is a T-handle.

9. The locking folding T-handle door latch of claim 1, wherein the cutout portion of the locking cam is generally semicircular in shape, and the first end of the slide bar is generally semicircular in shape and is adapted to seat in the cutout portion.

10. The locking folding T-handle door latch of claim 1, wherein the slide bar has a second end which is generally rounded.

11. The locking folding T-handle door latch of claim 10, wherein the slide bar activation cam has a generally curved contact portion rideably against the second end of the slide bar.

12. The locking folding T-handle door latch of claim 1, further comprising a spring loaded collar located under a portion of the handle joining the handle shaft.

13. The locking folding T-handle door latch of claim 1, wherein the locking cam rotatably rides on an underside of the pan.

14. The locking folding T-handle door latch of claim 13, wherein the latch cam is adjacent to the lock cam.

15. The locking folding T-handle door latch of claim 7, wherein the latch cam has a closed position contact area which is adapted to make contact with the slide retainer, and has an open position contact area which is adapted to make contact with the slide retainer.

16. The locking folding T-handle door latch of claim 1, wherein the slide bar is oblong.

17. The locking folding T-handle door latch of claim 1, further comprising a bracket for rotatably retaining an end of the handle shaft that extends below the locking cam.

18. The locking folding T-handle door latch of claim 17, wherein the handle shaft is at least partially threaded, and has nuts threaded thereon above and below the latch cam to provided for vertical position adjustability of the latch cam on the handle shaft.

19. The locking folding T-handle door latch of claim 1, wherein the handle shaft has a non-circular cross section and the locking cam and latch cam have complementary non-circular apertures formed therethrough for non-rotatable receipt of the handle shaft.

20. A locking folding T-handle door latch, comprising:

a handle;

a locking cam with a cutout portion;

a latch cam;

a handle shaft rotatably fixing the handle, the locking cam and the latch cam together;

a lock;

a pan with an aperture formed therethrough for the handle shaft and an aperture for the lock and a recess formed therein which is sized to receive the handle when the handle is folded down;

a slide bar activation cam turned by the lock;

a slide bar having a first end sized to fit at least partially into the cutout portion of the locking cam, the slide bar being located between the locking cam and the slide bar activation cam; and a slide retainer fixed to an underside of the pan for slidably retaining the slide bar;

wherein the slide bar is adapted to be moved into the cutout portion of the locking cam by locking the lock, which thereby prevents the handle from being turned to move the latch cam, and wherein when the lock is unlocked, the handle is adapted to be turned to move the first end of the slide bar out of the cutout portion of the locking cam to thereby permit turning the latch cam, and wherein the latch cam has a closed position contact area which is adapted to make contact with the slide retainer, and has an open position contact area which is adapted to make contact with the slide retainer.

21. A locking folding T-handle door latch, comprising:

a handle;

a latch cam with a cutout portion;

a handle shaft rotatably fixing the handle, the locking cam and the latch cam together;

a lock;

a pan with an aperture formed therethrough for the handle shaft and an aperture for the lock;

a slide bar activation cam turned by the lock; and a slide bar having a first end sized to fit at least partially into the cutout portion, the slide bar being located between the latch cam and the slide bar activation cam;

wherein the slide bar is adapted to be moved into the cutout portion of the latch cam by locking the lock, which prevents the handle from being turned to move the latch cam, and wherein when the lock is unlocked, the handle is adapted to be turned to move the first end of the slide bar out of the cutout portion of the latch cam to thereby permit turning the latch cam.

* * * * *

UNITED STATES PATENT AND TRADEMARK OFFICE

CERTIFICATE OF CORRECTION

PATENT NO. : 6,530,250 B1
DATED : March 11, 2003
INVENTOR(S) : Linares et al.

It is certified that error appears in the above-identified patent and that said Letters Patent is hereby corrected as shown below:

Drawings,
FIG. 1, include reference numeral 81 which points to seal washers.

Column 6,
Lines 21 and 32, delete the word "portion"

Signed and Sealed this

Twenty-third Day of September, 2003

JAMES E. ROGAN
*Director of the United States Patent and Trademark Office*